US007269369B2

(12) United States Patent
Tezuka et al.

(10) Patent No.: US 7,269,369 B2
(45) Date of Patent: Sep. 11, 2007

(54) IMAGE FORMING APPARATUS WITH REDUCED PAPER CONSUMPTION

(75) Inventors: Hiroki Tezuka, Tokyo (JP); Yasuo Kizaki, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 11/114,076

(22) Filed: Apr. 26, 2005

(65) Prior Publication Data

US 2005/0260003 A1 Nov. 24, 2005

(30) Foreign Application Priority Data

May 7, 2004 (JP) ..... 2004-139088

(51) Int. Cl.
*G03G 15/00* (2006.01)

(52) U.S. Cl. ..... 399/72; 399/49

(58) Field of Classification Search ..... 399/72, 399/49, 60

See application file for complete search history.

(56) References Cited

U.S. PATENT DOCUMENTS

| | | | | |
|---|---|---|---|---|
| 5,450,165 | A * | 9/1995 | Henderson | 399/49 |
| 6,243,542 | B1 | 6/2001 | Fujimoto et al. | 399/49 |
| 6,693,654 | B2 * | 2/2004 | Shinohara | 399/49 |
| 6,731,889 | B2 * | 5/2004 | Nakayama | 399/49 |
| 6,853,815 | B2 | 2/2005 | Tezuka et al. | 399/39 |
| 6,898,381 | B2 | 5/2005 | Maebashi et al. | 399/15 |
| 7,097,270 | B2 | 8/2006 | Yamazaki | 347/19 |
| 7,151,248 | B2 * | 12/2006 | Harush et al. | 399/49 |
| 7,206,068 | B2 * | 4/2007 | Suzuki | 399/49 |
| 2002/0181964 | A1 * | 12/2002 | Campbell et al. | 399/49 |
| 2003/0085941 | A1 | 5/2003 | Tezuka et al. | 347/19 |
| 2003/0090693 | A1 | 5/2003 | Tezuka et al. | 358/1.9 |
| 2003/0138261 | A1 | 7/2003 | Tezuka et al. | 399/49 |
| 2004/0042807 | A1 * | 3/2004 | Nakayama | 399/49 |
| 2004/0062560 | A1 * | 4/2004 | Mochizuki et al. | 399/49 |
| 2004/0096231 | A1 * | 5/2004 | Furno et al. | 399/49 |
| 2004/0208662 | A1 * | 10/2004 | Ichikawa et al. | 399/49 |
| 2005/0248789 | A1 | 11/2005 | Kita et al. | 358/1.9 |
| 2005/0260004 | A1 | 11/2005 | Maebashi et al. | 399/15 |
| 2006/0023272 | A1 | 2/2006 | Tezuka | 358/518 |

FOREIGN PATENT DOCUMENTS

| | | |
|---|---|---|
| CN | 1410841 | 4/2003 |
| EP | 1 152 598 A2 | 11/2001 |
| EP | 1 291 731 A1 | 3/2003 |
| EP | 1 298 500 A2 | 4/2003 |
| EP | 1 310 832 A | 5/2003 |
| JP | 07-055703 | 3/1995 |
| JP | 11-119481 | 4/1999 |

(Continued)

*Primary Examiner*—Susan Lee
(74) *Attorney, Agent, or Firm*—Fitzpatrick, Cella, Harper & Scinto

(57) ABSTRACT

In a color image forming apparatus, a user need not exchange a sensor, paper is prevented from being wastefully consumed, and image quality and color reproducibility can be improved. The color image forming apparatus includes a detecting unit which detects the density or chromaticity of a test image formed on a recording medium, and a correction unit which corrects the density or chromaticity of the image by using the detection result obtained by the detection unit. The detection units are arranged in the first direction perpendicular to the convey direction of the recording medium.

10 Claims, 15 Drawing Sheets

FOREIGN PATENT DOCUMENTS

| | | |
|---|---|---|
| JP | 11-136532 A | 5/1999 |
| JP | 3430702 | 5/2002 |
| JP | 2003-084532 | 3/2003 |
| JP | 2003-150006 | 5/2003 |
| JP | 2003-287934 | 10/2003 |

* cited by examiner

IMAGE FORMING APPARATUS WITH REDUCED PAPER CONSUMPTION

FIELD OF THE INVENTION

The present invention relates to a technique for improving the quality and color reproducibility of an image formed by an image forming apparatus such as a color printer and color copying machine.

BACKGROUND OF THE INVENTION

Recently, electrophotographic or inkjet color image forming apparatuses represented by a color printer and color copying machine require higher quality of an output image.

However, the color of the image obtained by the color image forming apparatus varies when each part of the apparatus varies upon a change in environment or long-time use. Especially, in the electrophotographic color image forming apparatus, the color may vary upon even small environmental variations, thereby losing color balance. Hence, the electrophotographic color image forming apparatus has a means for stably reproducing the color and color tonality. For example, the color image forming apparatus comprises, for toner of each color, process conditions such as several exposure amounts and bias for development in accordance with different absolute humidities, and a tonality correction means such as a look-up table (LUT). The color image forming apparatus selects process conditions optimal for the environment and the optimal value of tonality correction on the basis of an absolute humidity measured by a temperature/humidity sensor. In order to obtain a constant color and color tonality even upon variations in each part of the apparatus, the following density control is performed (see Japanese Patent Laid-Open No. 7-055703, and Japanese Patent No. 3430702). First, a toner patch for detecting density is formed on an intermediate transfer material, photosensitive drum, or the like with each of single-color toners. The density of the unfixed single-color toner patch is detected by an unfixed toner density detection sensor (to be referred to as a density sensor hereinafter). Then, feedback control of the tonality correction means such as the process conditions (e.g., the exposure amount and the bias for development) and the LUT is done on the basis of the detection result.

In density control using the above density sensor, a patch (test image) is formed on an intermediate transfer material, photosensitive drum, or the like, and the density is detected. A change in the color balance of an image subsequently transferred and fixed onto a transfer material is not controlled. The color balance also changes depending on the transfer efficiency of transferring a toner image onto a transfer material and the heating and press for fixing. Such change cannot be dealt with by the density control using the above density sensor.

Also, since only the single-color patch is formed in this density control, a change in the color balance of the image that is caused by mixing of the plurality of color toners is not controlled.

To solve this problem, the following color image forming apparatus has been proposed (for example, see Japanese Patent Laid-Open No. 2003-084532), which comprises a sensor (to be referred to as a color sensor hereinafter) for detecting the chromaticity and density of the patch on a transfer material such that the mixture rate of cyan (C), magenta (M), and yellow (Y) for forming an achromatic gray scale image of a process gray patch can be output by forming a gray patch of black (K) and the process gray patch of C, M, and Y on the transfer material, and comparing the gray patch of K with the process gray patch of C, M, and Y as a reference after fixing the toner.

In this color image forming apparatus, the detection result is fed back to, e.g., a color matching table for converting the exposure amount and process conditions of the image forming section and the RGB signal of the image processor into the color reproduction range of the color image forming apparatus, a color separation table for converting the RGB signal into a CMYK signal, and a calibration table for correcting characteristics of density to tonality. With this operation, the density or chromaticity control of the final output image on the transfer material can be performed. The output image formed by the color image forming apparatus can be detected by an external image reading apparatus or a colorimeter/densitometer to perform the same control. In addition to this, the advantage of this scheme is that the control can be completely performed in the image forming apparatus. For example, this color sensor includes three or more types of filters having different spectral transmittances of, e.g., red (R), green (G), and blue (B) on a light-receiving device by using three or more types of light sources having emission spectra of, e.g., red (R), green (G), and blue (B) as a light-emitting device, or using a light source for emitting white (W) light as the light-emitting device. In this arrangement, three or more types of outputs such as R, G, and B outputs can be obtained.

In the inkjet color image forming apparatus, the color balance also changes due to aging or the environmental difference of an ink discharge amount, or the individual difference of ink cartridges. The characteristics of density to tonality cannot be held constant. To solve this problem, in some cases, the image forming apparatus detects the density or chromaticity of the patch on the transfer material to perform the density or chromaticity control, by using an inkjet head in place of the color sensor.

However, since only one color sensor is mounted for each conventional electrophotographic color image forming apparatus, the patch must be formed at a detectable position limited depending on a sensor position such as the center of the transfer material in a direction (to be referred to as a scan direction (first direction) hereinafter) substantially perpendicular to (crossing) the moving (convey) direction of the transfer material.

Alternatively, in the electrophotographic color image forming apparatus, the density and chromaticity vary even with a patch having the same signal in the scan direction, thus posing a problem. This is caused by small variations in transfer characteristics of toner at the center and side of the transfer material, and small variations in fixing characteristics of a fixing unit which fixes the toner onto the transfer material by heating and pressing, at the center and side of the transfer material.

Therefore, the conventional color image forming apparatus including the color sensor can improve the color reproducibility, but cannot follow the density and chromaticity variations on the single transfer material.

Also, since the density and chromaticity can be detected only by using the patches formed at the determined position such as the center of the transfer material, the number of patches to be formed on the single transfer material is limited. Also, in order to form the patches for controlling the density or chromaticity, the color image forming apparatus must form patches on a plurality of transfer material in one control process, or reduce the number of patches to form a maximum number of patches on the single transfer material with lower precision.

In the inkjet color image forming apparatus which adopts a scheme for exchanging the inkjet head for the color sensor, since the color sensor moves in the scan direction as the inkjet head, the electrophotographic color image forming apparatus has no problem. However, a user must exchange the inkjet head for the color sensor, resulting in a cumbersome operation.

In addition to this, while the electrophotographic color image forming apparatus may include a movable color sensor as the inkjet color image forming apparatus, in this scheme, the transfer material must be stopped outside the fixing unit when moving the color sensor in the scan direction. In order to perform such processing, the color sensor must be separated from the fixing unit by at least the length of the longest transfer material. Hence, this scheme cannot cope with a color image forming apparatus in which the fixing unit is near the discharge section.

SUMMARY OF THE INVENTION

In the above situation, it is an object of the present invention to provide a color image forming apparatus which mounts a color sensor which can detect a density or chromaticity at a plurality of positions in a scan direction without imposing an excessive load on a user, improves the image quality of the color image forming apparatus by detecting and reducing density or chromaticity variations on a single transfer material in the scan direction by using the color sensor, and improves the color reproducibility of the color image forming apparatus by forming and detecting a maximum number of patches on a single transfer material.

According to the present invention, an image forming apparatus comprises a plurality of detecting sections which detect densities or chromaticity values of test images formed on a recording medium, and an image forming section which controls to form an image by using detection results obtained by the detecting sections, characterized in that the plurality of detecting sections are arranged in a first direction perpendicular to a convey direction of the recording medium.

According to the present invention, the user need not exchange the sensor, wasteful consumption of paper is prevented, and the image quality and color reproducibility can be improved.

Another object, arrangement, and effect of the present invention will be apparent from the following detail description taken in conjunction with the accompanying drawings.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described in detail below with reference to the accompanying drawings.

Note that the following embodiments are examples of a means for realizing the present invention. The embodiments must be modified or changed as needed in accordance with the arrangement or various conditions of the apparatus to which the present invention is applied. The present invention is not limited to the following embodiments.

Of course, the present invention is also achieved when a storage medium (or recording medium) which stores software program codes for realizing the functions of a color image forming apparatus in the embodiments (to be described later) is supplied to a system or apparatus, and the computer (or the CPU or MPU) of the system or apparatus reads out and executes the program codes stored in the storage medium.

First Embodiment

Figure 1:
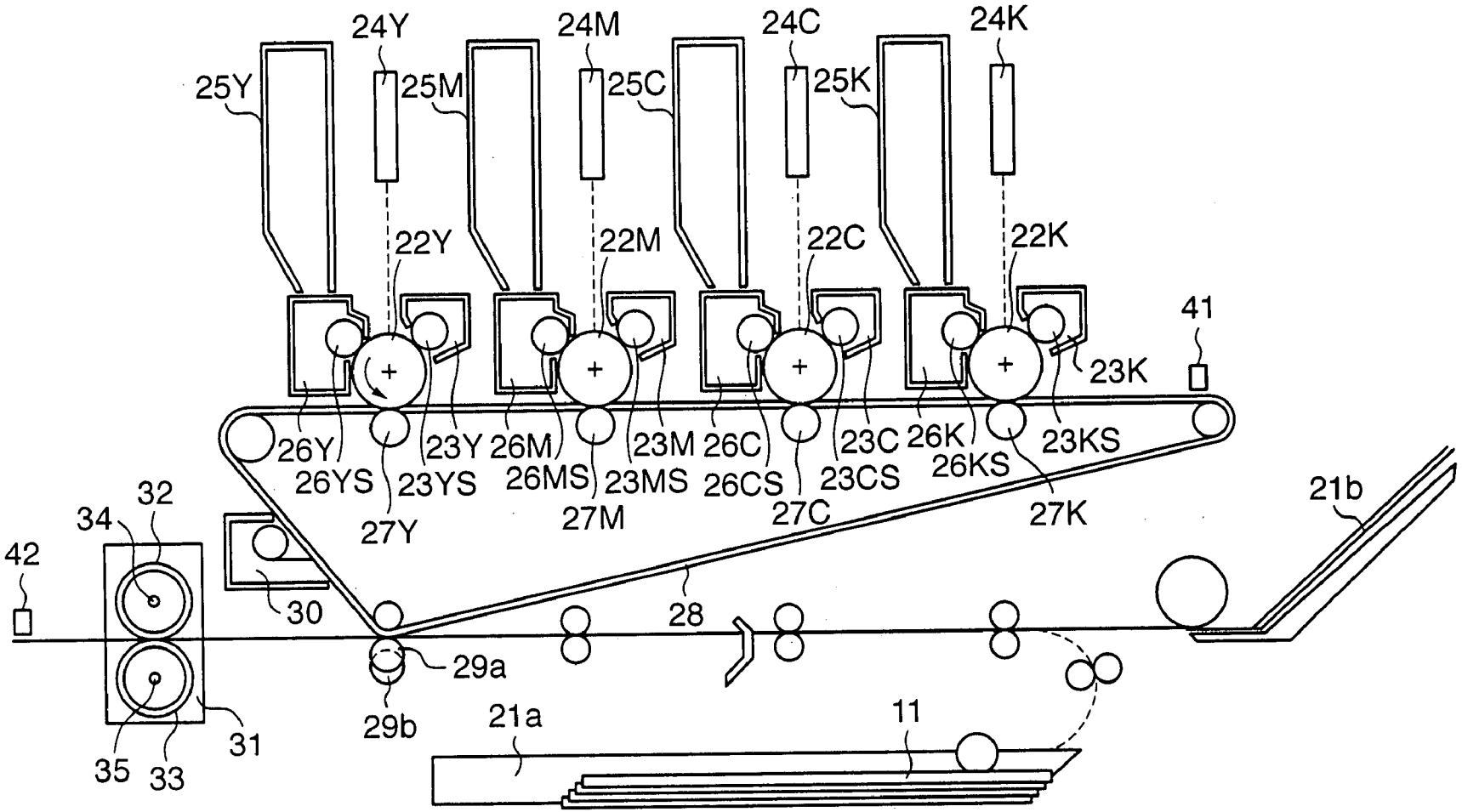
FIG. 1 is a main sectional view showing the arrangement of an image forming section of a color image forming apparatus exemplified according to the first embodiment.

FIG. 1 is a main sectional view showing the arrangement of the image forming section of a color image forming apparatus according to the first embodiment. As shown in FIG. 1, this apparatus is a tandem color image forming apparatus adopting an intermediate transfer material 28 as an example of an electrophotographic color image forming apparatus.

The color image forming apparatus according to the first embodiment includes the image forming section shown in FIG. 1, and an image processor (not shown).

First, a process performed in the image processor will be described below.

Figure 2:
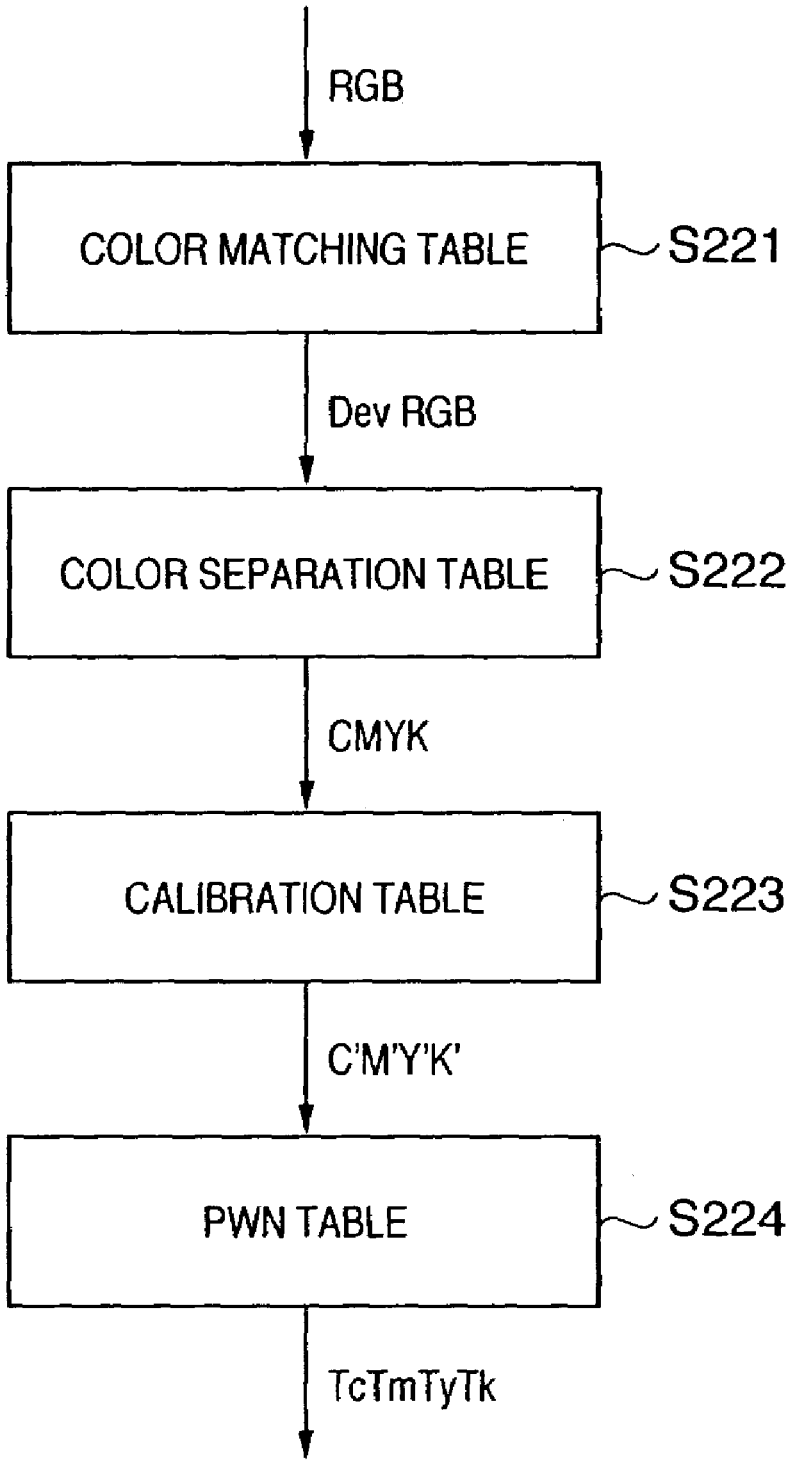
FIG. 2 is a flowchart showing a process in an image processor.

FIG. 2 is a flowchart for explaining an example of a process in an image processor of the color image forming apparatus.

In step S221 in FIG. 2, R, G, and B signals representing the color of the image sent from a personal computer or the like are converted into device R, G, and B signals (to be referred to as Dev R, G, and B signals hereinafter) complying with the color reproduction range of the color image forming apparatus on the basis of a color matching table prepared in advance. In step S222, the Dev R, G, and B signals are converted into C, M, Y, and K signals corresponding to the colors of toner coloring materials of the color image forming apparatus on the basis of a color separation table prepared in advance. In step S223, the C, M, Y, and K signals are converted into C', M', Y', and K' signals upon correcting characteristics of density to tonality on the basis of a calibration table for correcting the characteristics of density to tonality specific to each color image forming apparatus. In step S224, the C', M', Y', and K' signals are converted into exposure times Tc, Tm, Ty, and Tk of the scanners 24C, 24M, 24Y, and 24K corresponding to the C', M', Y', and K' signals using a PWM (Pulse Width Modulation) table.

Next, with reference to FIG. 1, the operation of the image forming section in the electrophotographic color image forming apparatus will be described.

In the image forming section, static latent images are formed by exposure light which is turned on on the basis of the exposure time converted by the image processor (not shown), and these static latent images are developed to form single-color toner images. The single-color toner images are superposed on each other to form a multi-color toner image. The multi-color toner image is transferred onto a transfer material 11, and the multi-color toner image on the transfer material 11 is fixed.

More specifically, the image forming section comprises paper feeders 21*a* and 21*b*, photosensitive members 22Y, 22M, 22C, and 22K corresponding to stations which are arranged side by side by the number of developing colors, injection charge means 23Y, 23M, 23C, and 23K as primary charge means, toner cartridges 25Y, 25M, 25C, and 25K, developing means 26Y, 26M, 26C, and 26K, primary transfer rollers 27Y, 27M, 27C, and 27K, the intermediate transfer material 28, a secondary transfer roller 29, a cleaning means 30, a fixing unit 31, a density sensor 41, and a color sensor 42.

Each of the photosensitive drums (photosensitive members) 22Y, 22M, 22C, and 22K is configured by forming an organic photoconductive layer around an aluminum cylinder. The photosensitive drums 22Y, 22M, 22C, and 22K are rotated by transmitting the driving force of a driving motor (not shown). The driving motor rotates the photosensitive drums 22Y, 22M, 22C, and 22K counterclockwise in accordance with image forming operation.

The respective stations comprise, as primary charge means, the four injection chargers 23Y, 23M, 23C, and 23K for respectively charging the photosensitive members 22Y, 22M, 22C, and 22K for yellow (Y), magenta (M), cyan (C), and black (K). The respective chargers comprise sleeves 23YS, 23MS, 23CS, and 23KS.

Exposure light sent to the photosensitive drums 22Y, 22M, 22C, and 22K are emitted by corresponding scanners 24Y, 24M, 24C, and 24K, and selectively expose the surfaces of the photosensitive drums 22Y, 22M, 22C, and 22K to form static latent images.

In order to visualize the above static latent images, the respective stations comprise, as developing means, the four developers 26Y, 26M, 26C, and 26K for development in yellow (Y), magenta (M), cyan (C), and black (K), and the respective developers comprise sleeves 26YS, 26MS, 26CS, and 26KS. These developers are detachably attached to the image forming apparatus.

The intermediate transfer material 28 rotates clockwise in forming a color image, and a single-color toner image is transferred along with the rotation of the photosensitive drums 22Y, 22M, 22C, and 22K and the primary transfer rollers 27Y, 27M, 27C, and 27K opposing these photosensitive drums 22Y, 22M, 22C, and 22K. The single-color toner image is transferred onto the intermediate transfer material 28 by applying an adequate bias voltage to the primary transfer roller 27, and making a difference between the rotational speeds of the photosensitive drum 22 and the intermediate transfer material 28. This operation is called primary transfer.

After that, the secondary transfer roller 29 comes into contact with the intermediate transfer material 28 to clamp and convey the transfer material 11, and the multi-color toner image on the intermediate transfer material 28 is transferred onto the transfer material 11. An adequate bias voltage is applied to the secondary transfer roller 29 to statically transfer a toner image. This operation is called secondary transfer. While transferring the multi-color toner image onto the transfer material 11, the secondary transfer roller 29 abuts against the transfer material 11 at a position 29*a*, and deviates from the transfer material 11 to a position 29*b* after printing.

The fixing unit 31 fuses and fixes the multi-color toner image transferred onto the transfer material while conveying the transfer material 11. As shown in FIG. 1, the fixing unit 31 comprises a fix roller 32 which heats the transfer material 11, and a press roller 33 which presses the transfer material 11 against the fix roller 32. The fix roller 32 and press roller 33 are formed into a cylindrical shape, and incorporate heaters 34 and 35, respectively. The transfer material 11 bearing the multi-color toner image is conveyed by the fix roller 32 and press roller 33, and receives heat and pressure to fix toner onto the transfer material.

After that, the transfer material 11 on which the toner image has been fixed is discharged onto a delivery tray (not shown) by a discharge roller (not shown), and image forming operation ends.

The cleaning means 30 removes toner remaining on the intermediate transfer material 28. After the four-color toner image on the intermediate transfer material 28 is transferred onto the transfer material 11, the removed waste toner is stored in a cleaner container.

In the color image forming apparatus shown in FIG. 1, the density sensor 41 faces the intermediate transfer material 28, and is used to measure the density of the toner patch formed on the surface of the intermediate transfer material 28.

Figure 3:
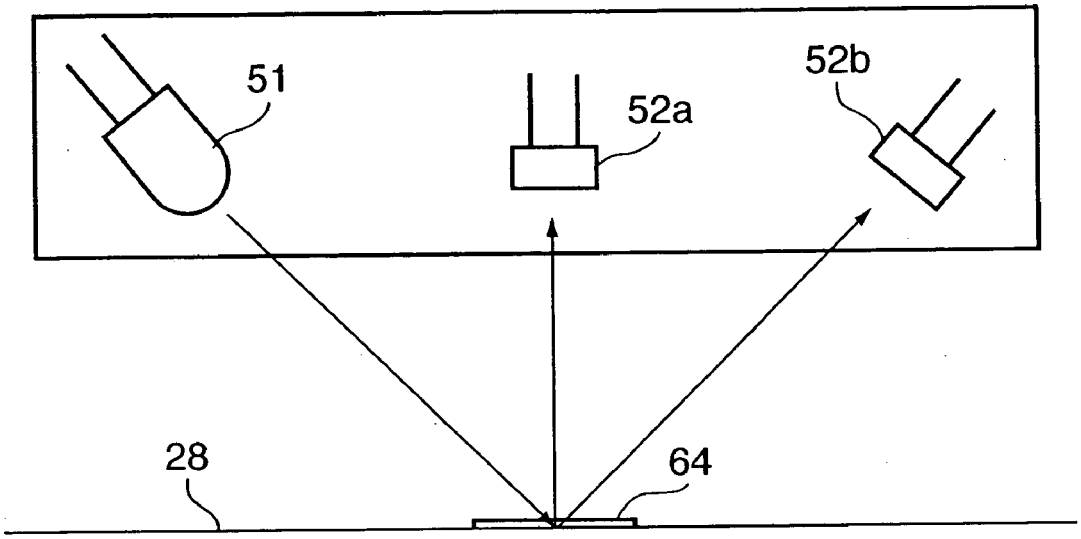
FIG. 3 is a view showing the arrangement of a density sensor.

FIG. 3 is a view for explaining the arrangement of the density sensor 41. The density sensor 41 is made up of an infrared light emitting device 51 such as an LED, light-receiving devices 52*a* and 52*b* such as a photodiode and CdS, an IC (not shown) for processing light receiving data, and a holder (not shown) which stores these components.

The light-receiving device 52*a* detects the intensity of light diffusely reflected by a toner patch 64, and the light-receiving device 52*b* detects the intensity of light regularly reflected by the toner patch 64. The high to low density of the toner patch can be obtained by detecting the intensities of the regular reflected light and the diffused reflected light. Note that an optical device (not shown) such as a lens may be used to couple the light emitting device 51 and light-receiving device 52*a* and 52*b*.

The color sensor 42 is arranged on the downstream side of the fixing unit 31 on the transfer material convey path so as to face the image forming surface of the transfer material 11. The color sensor 42 detects the color of a fixed color-mixed patch formed on the transfer material 11, and outputs an RGB value. Accordingly, since the color sensor 42 is arranged in the color image forming apparatus, the density can be automatically detected before the fixed image is delivered to the delivery unit.

Figure 4:
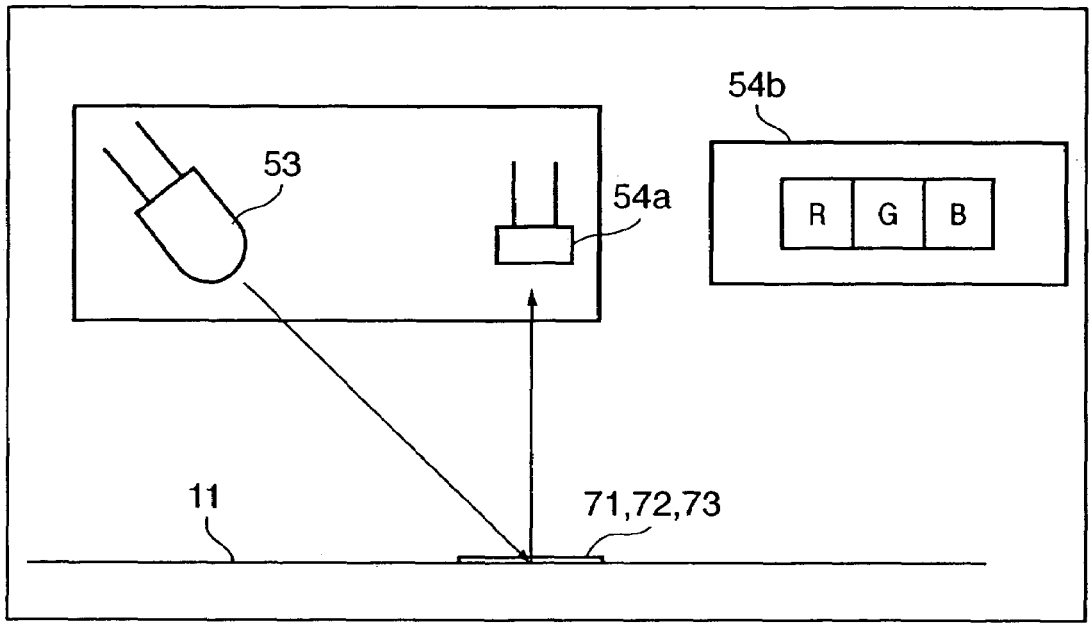
FIG. 4 is a view showing the arrangement of a color sensor.

FIG. 4 is a view showing the arrangement of the color sensor 42. The color sensor 42 comprises a white LED 53 and a charge storage sensor 54*a* with on-chip filter of three R, G, and B colors. Light is emitted by the white LED 53 obliquely at 45° to the transfer material 11 having fixed patches 71 to 73, and the intensity of light diffusedly reflected at 0° is detected by the charge storage sensor 54*a* with the RGB on-chip filter. The light receiving portion of the charge storage sensor 54*a* with the RGB on-chip filter is a sensor 54*b* that has independent R, G, and B pixels. The charge storage sensor 54*a* with the RGB on-chip filter may be a photodiode, or several sets of three R, G, and B pixels may be arranged side by side. The incident angle may be 0°, and the reflection angle may be 45°. The charge storage sensor may be made up of an LED which emits beams of three, R, G, and B colors or more and a sensor with no filter.

Next, a method of correcting the density or chromaticity variations in the scan direction according to the first embodiment will be described.

Figure 5:
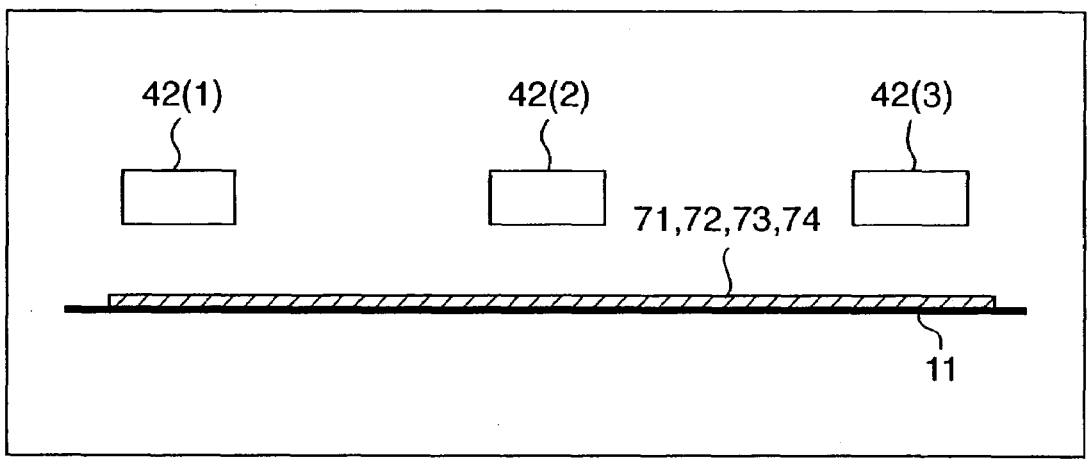
FIG. 5 is a view showing the arrangement of the color sensor according to the first embodiment.

In the first embodiment, a plurality of color sensors 42 are arranged over a whole image forming region in the scan direction as shown in FIG. 5. In this embodiment, three color sensors 42(1) to 42(3) are arranged. However, the number of color sensors 42 need not be limited. The larger the number of color sensors used, the higher the precision of the control process (to be described later). In the prior art in which the color sensors 42 control the density or chromaticity, one of the color sensors 42 is used.

Figure 6:
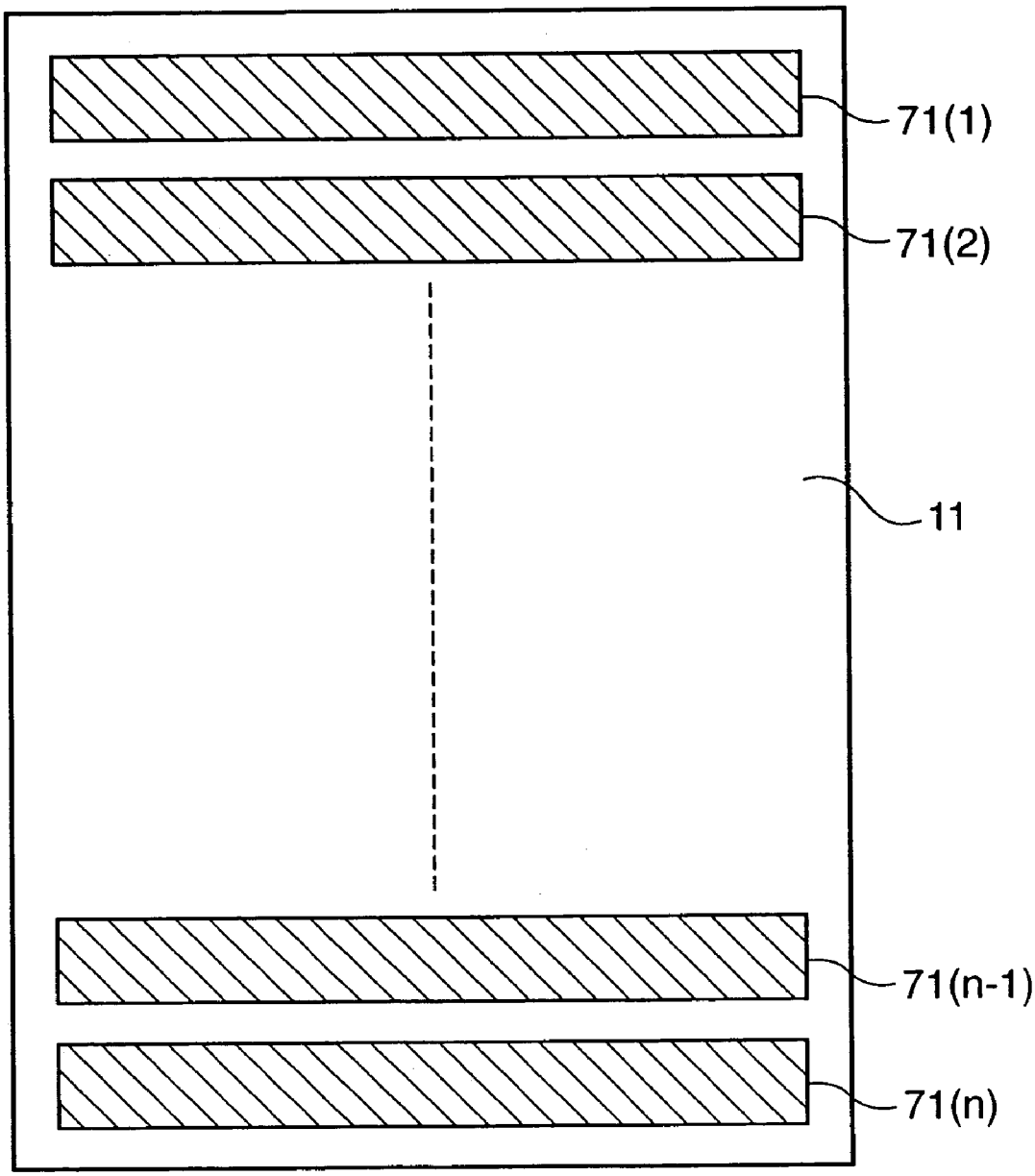
FIG. 6 is a view showing an example of a patch pattern according to the first embodiment.

FIG. 6 shows an example of a patch pattern formed on the transfer material 11. N fixed single-color patches 71(1) to 71(*n*) are arranged. These single-color patches have the same image signal, and different primary transfer biases.

Figure 7:
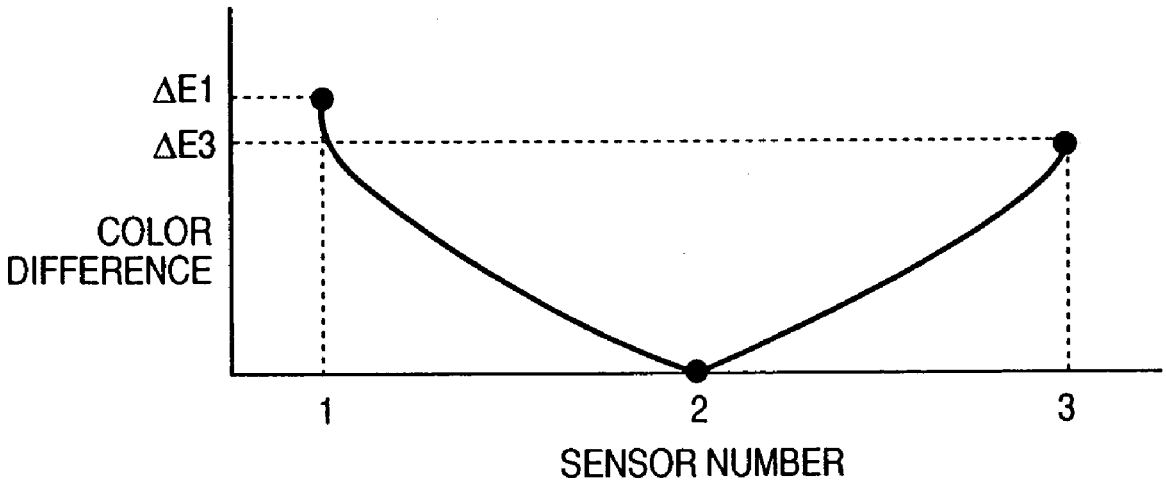
FIG. 7 is a view showing the detection result of the color sensor according to the first embodiment.

The chromaticity values of the patches are detected by color sensors 42(1) to 42(3). The chromaticity values of the patches detected by the color sensors 42(1) to 42(3) are then compared with each other. If there is no chromaticity variation in the scan direction, the chromaticity values detected by the three color sensors 42(1) to 42(3) are assumed to be equal. If not, the chromaticity values detected by the three color sensors 42(1) to 42(3) are assumed to be different from each other. FIG. 7 shows one of the detection results obtained by the three color sensors 42(1) to 42(3). FIG. 7 shows the chromaticity variations in the scan direction. Note that the ordinate represents a color difference with reference to the chromaticity detected by the color sensor 42(2) at the center in the scan direction.

To cope with the variations, the chromaticity variations in the scan direction by the primary transfer bias are quantified. In order to obtain the quantified value, for example, a method of obtaining the maximum value, the average value, or the standard deviation of the color differences obtained when a large number of color sensors 42 is used is available.

A primary transfer bias with a smallest chromaticity variation is then selected, and this transfer bias is set in the following image forming.

Furthermore, when the chromaticity variation amount exceeds the predetermined value even in the primary transfer bias with the smallest chromaticity variation, the toner is stirred once in the developing means 26 such that the toner is uniformly applied onto the photosensitive member 22 in the scan direction when developing the image. After that, the same control is performed again.

As described above, the primary transfer bias corresponding to a given color is set. However, when a plurality of color toners are used to adjust the corresponding primary transfer biases, the optimal primary transfer biases are preferably set in correspondence with the respective colors.

Figure 8:
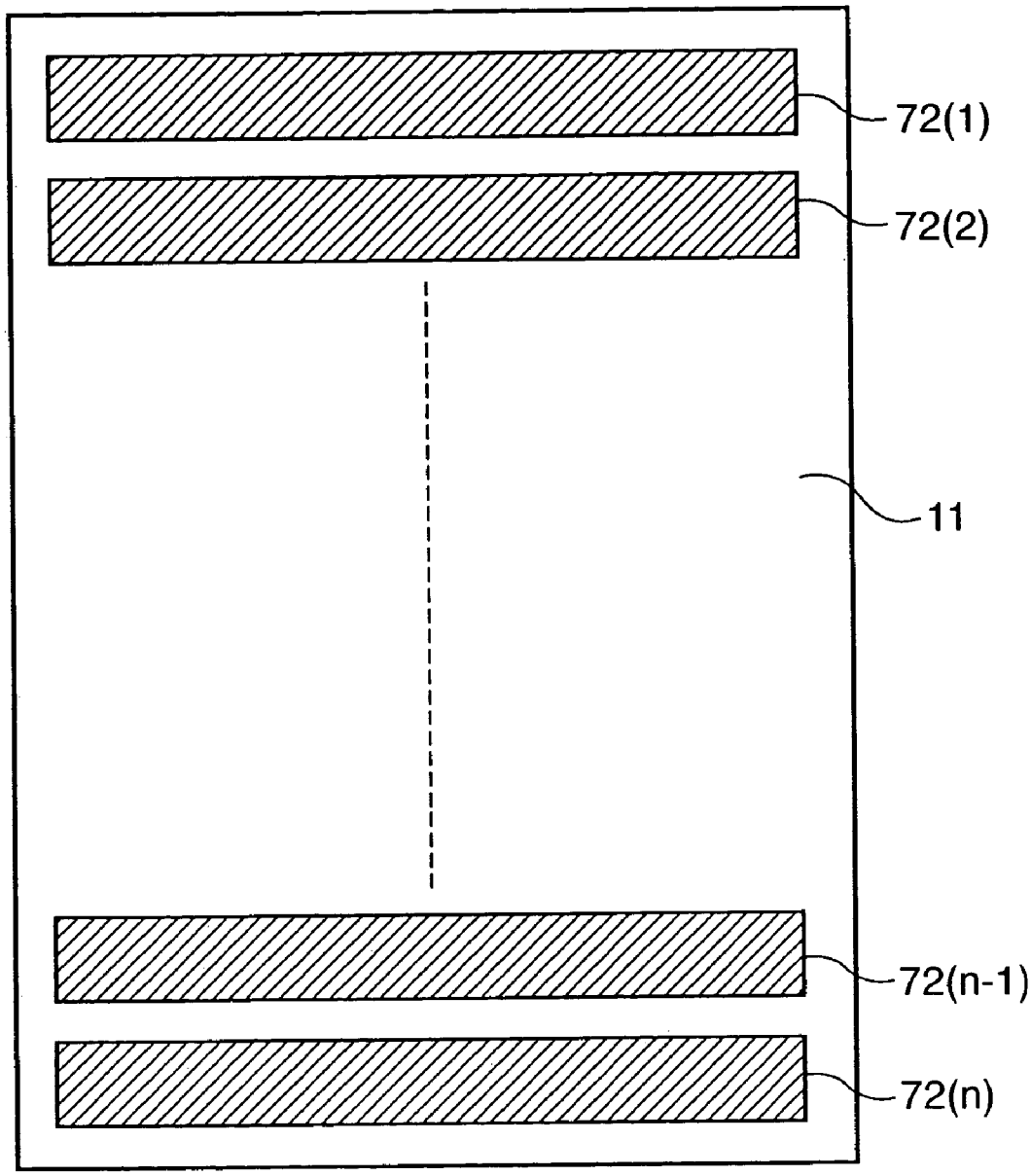
FIG. 8 is a view showing an example of a patch pattern according to the first embodiment.

Next, the patches are formed on the transfer material 11 again. FIG. 8 shows an example of a patch pattern formed on the transfer material 11. N fixed patches 72(1) to 72(*n*) are arranged. These patches have the same image signal, and different secondary transfer biases. Note that the patches may be single-color or multi-color patches.

Figure 9:
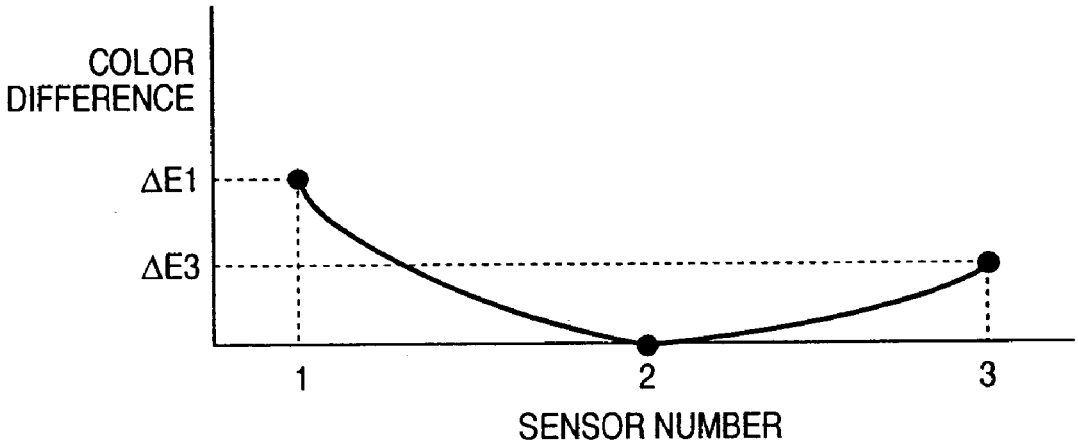
FIG. 9 is a view showing the detection result of the color sensor according to the first embodiment.

The chromaticity values of the patches are detected by the color sensors 42(1) to 42(3). The chromaticity values of the patches detected by the color sensors 42(1) to 42(3) are then compared with each other. If there is no chromaticity variation in the scan direction, the chromaticity values detected by the three color sensors 42(1) to 42(3) are assumed to be equal. If not, the chromaticity values detected by the three color sensors 42(1) to 42(3) are assumed to be different from each other. FIG. 9 shows one of the detection results obtained by the three color sensors 42(1) to 42(3). FIG. 9 shows the chromaticity variations in the scan direction. Note that the ordinate represents a color difference with reference to the chromaticity detected by the color sensor 42(2) at the center in the scan direction.

To cope with the variations, the chromaticity variations in the scan direction by the secondary transfer bias are quantified. In order to obtain the quantified value, for example, a method of obtaining the maximum value, the average value, or the standard deviation of the color differences obtained when a large number of color sensors 42 is used is available.

A secondary transfer bias with a smallest chromaticity variation is then selected, and this secondary transfer bias is set in the following image forming.

Furthermore, when the chromaticity variation amount exceeds the predetermined value even in the secondary transfer bias with the smallest chromaticity variation, the toner is stirred once in the developing means 26 such that the toner is uniformly applied onto the photosensitive member 22 in the scan direction when developing the image. After that, the same control is performed again.

Figure 10:
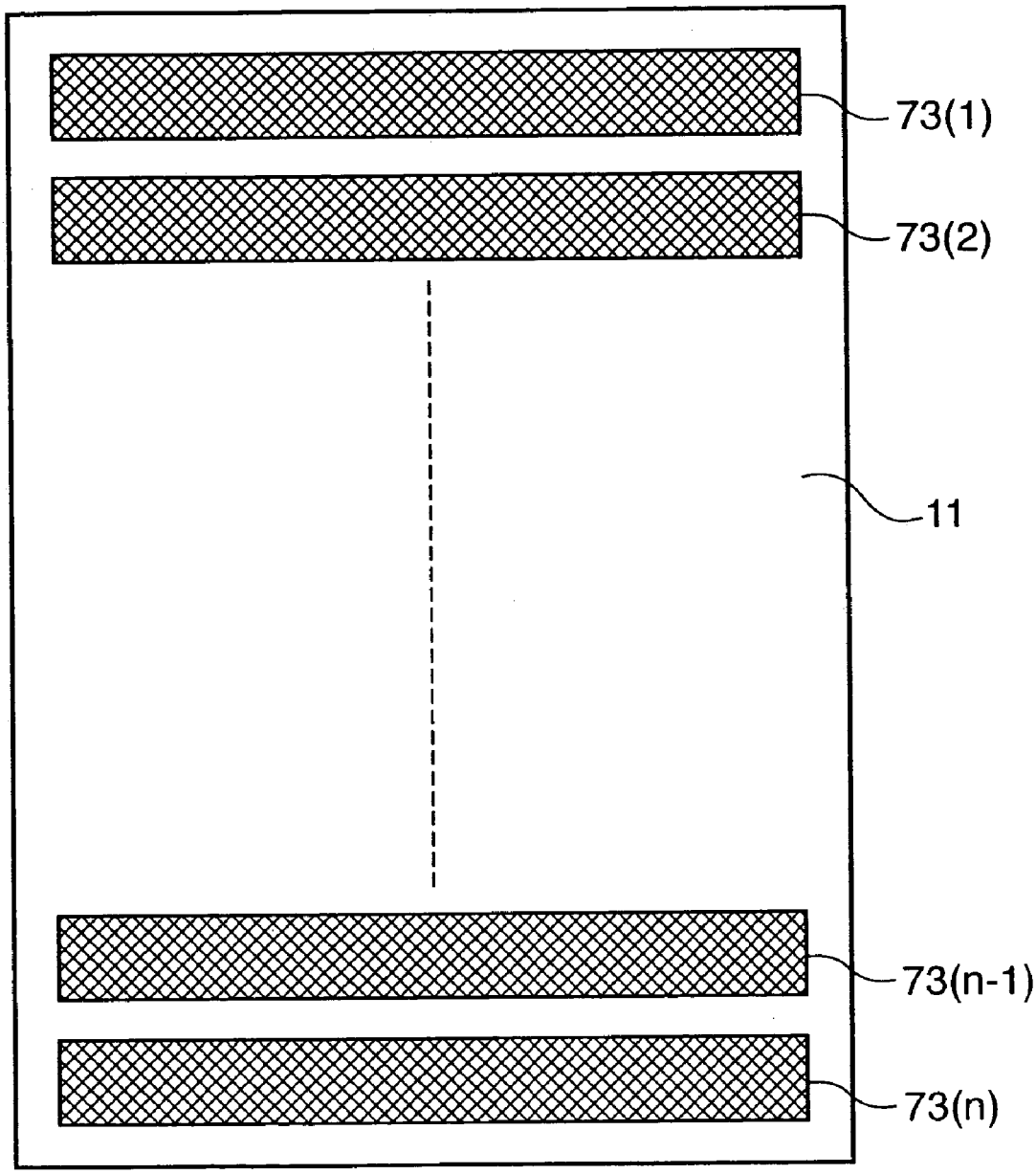
FIG. 10 is a view showing an example of a patch pattern according to the first embodiment.

The patches are further formed on the transfer material 11. FIG. 10 shows an example of a patch pattern formed on the transfer material 11. N fixed patches 73(1) to 73(*n*) are arranged. These patches have the same image signal, and different fixing temperatures of the fixing unit 31. Note that the patches may be single-color or multi-color patches.

Figure 11:
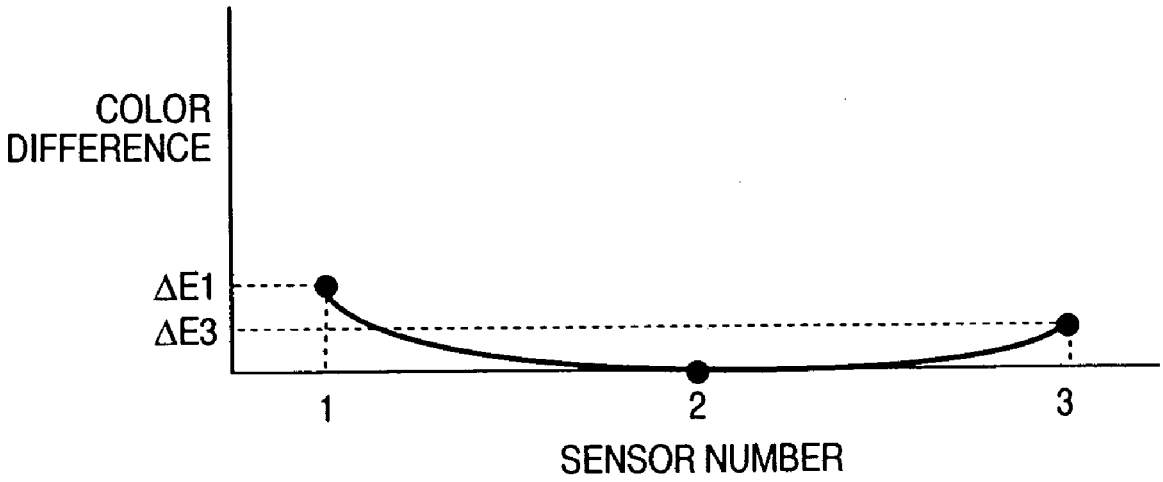
FIG. 11 is a view showing the detection result of the color sensor according to the first embodiment.

The chromaticity values of the patches are detected by the color sensors 42(1) to 42(3). The chromaticity values of the patches detected by the color sensors 42(1) to 42(3) are then compared with each other. If there is no chromaticity variation in the scan direction, the chromaticity values detected by the three color sensors 42(1) to 42(3) are assumed to be equal. If not, the chromaticity values detected by the three color sensors 42(1) to 42(3) are assumed to be different from each other. FIG. 11 shows one of the detection results obtained by the three color sensors 42(1) to 42(3). FIG. 11 shows the chromaticity variations in the scan direction. Note that the ordinate represents a color difference with reference to the chromaticity detected by the color sensor 42(2) at the center in the scan direction.

To cope with the variations, the chromaticity variations in the scan direction in the fixing temperatures are quantified. In order to obtain the quantified value, for example, a method of obtaining the maximum value, or the standard deviation of the color differences obtained when a large number of color sensors 42 is used is available.

A fixing temperature with a smallest chromaticity variation is then selected, and this fixing temperature is set in the following image forming.

Furthermore, when the chromaticity variation amount exceeds the predetermined value even in the fixing temperature with the smallest chromaticity variation, the toner is stirred once in the developing means 26 such that the toner is uniformly applied onto the photosensitive member 22 in the scan direction when developing the image. After that, the same control is performed again. Note that the color sensor 42 can also measure the density by processing the sensor outputs of R, G, and B. Hence, it is apparent that the control result is equal to that in the first embodiment even when the density is detected in place of the chromaticity, and the conditions are set to obtain small density variations. In this case, the density variations may be quantified by using the difference between the maximum and minimum density values measured by the corresponding sensors, or the standard deviation of the density values.

As described above, the plurality of color sensors 42 control to optimize the primary transfer bias, secondary transfer bias, and fixing temperature. However, it is apparent that all of the three conditions need not be optimized, but only one or two known conditions which largely influence the density or chromaticity variations may be performed.

Figure 12:
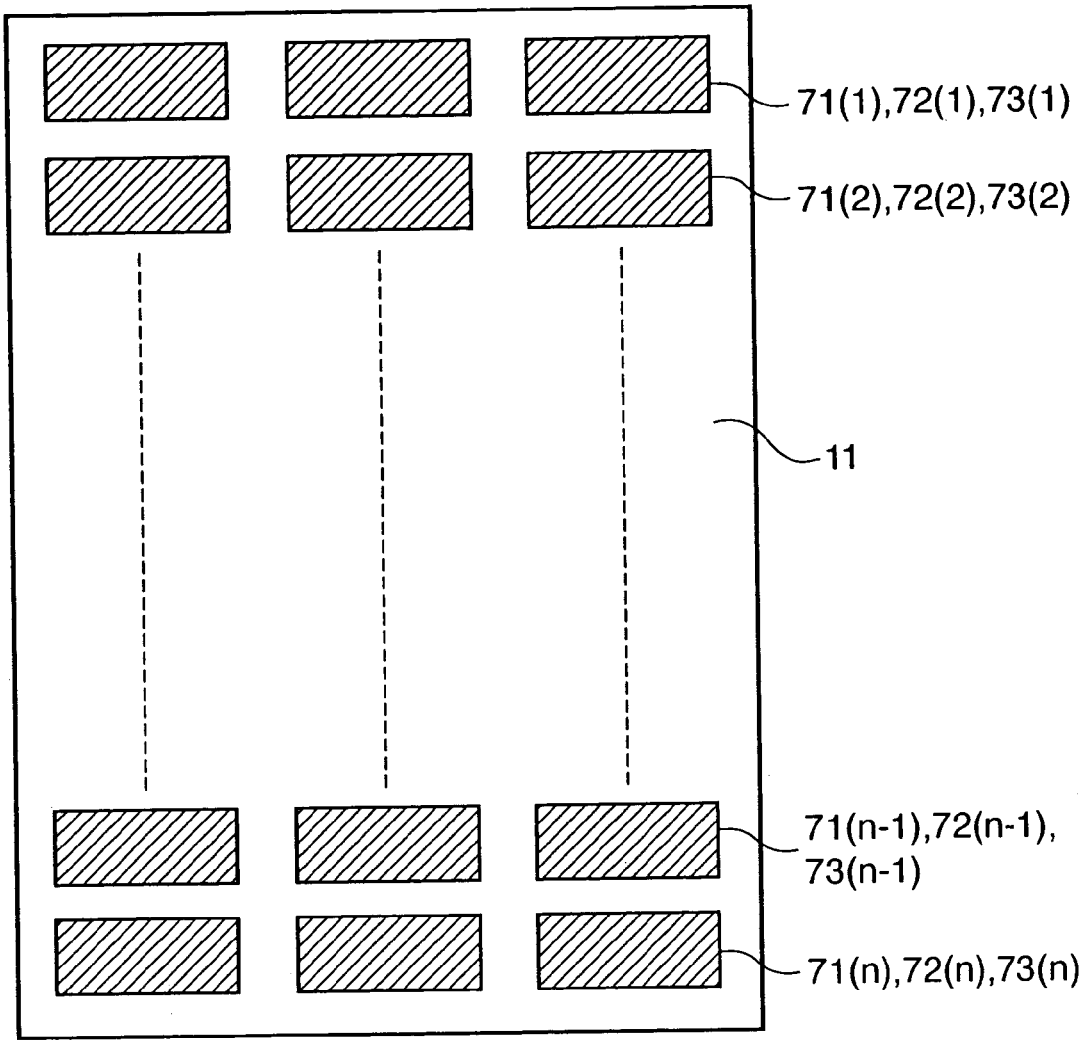
FIG. 12 is a view showing an example of a patch pattern according to the first embodiment.

The patch patterns 71, 72, and 73 formed on the transfer material 11 in FIGS. 6, 8, and 10 have patches corresponding to the same image signal through the scan direction. However, as shown in FIG. 12, it is apparent that the patch patterns 71, 72, and 73 may be formed only in the region in which the plurality of color sensors 42 arranged in the scan direction can detect the patches.

Also, it is apparent that, in the electrophotographic color image forming apparatus without the intermediate transfer material 28, the transfer bias from the photosensitive member 22 to the transfer material 11 can be optimized as in this scheme.

As described above, in this embodiment, the density variations in the scan direction caused by the primary transfer to the intermediate transfer material 28 and the development onto the photosensitive member 22, and the chromaticity variations caused by the secondary transfer to the transfer material 11 and the fixing performed by the fixing unit 31 can be reduced. As a result, the image quality of the color image forming apparatus can be further improved.

Second Embodiment

In the second embodiment, a method of forming a maximum number of patches on a single transfer material 11 will be described.

The structure and arrangement of the color sensor 42 is assumed to be same as that in the first embodiment. In not only the electrophotographic color image forming apparatus, but also the color image forming apparatus of another scheme, this embodiment can be implemented by arranging the plurality of color sensors 42 for detecting the final image, in the scan direction.

Figure 13:
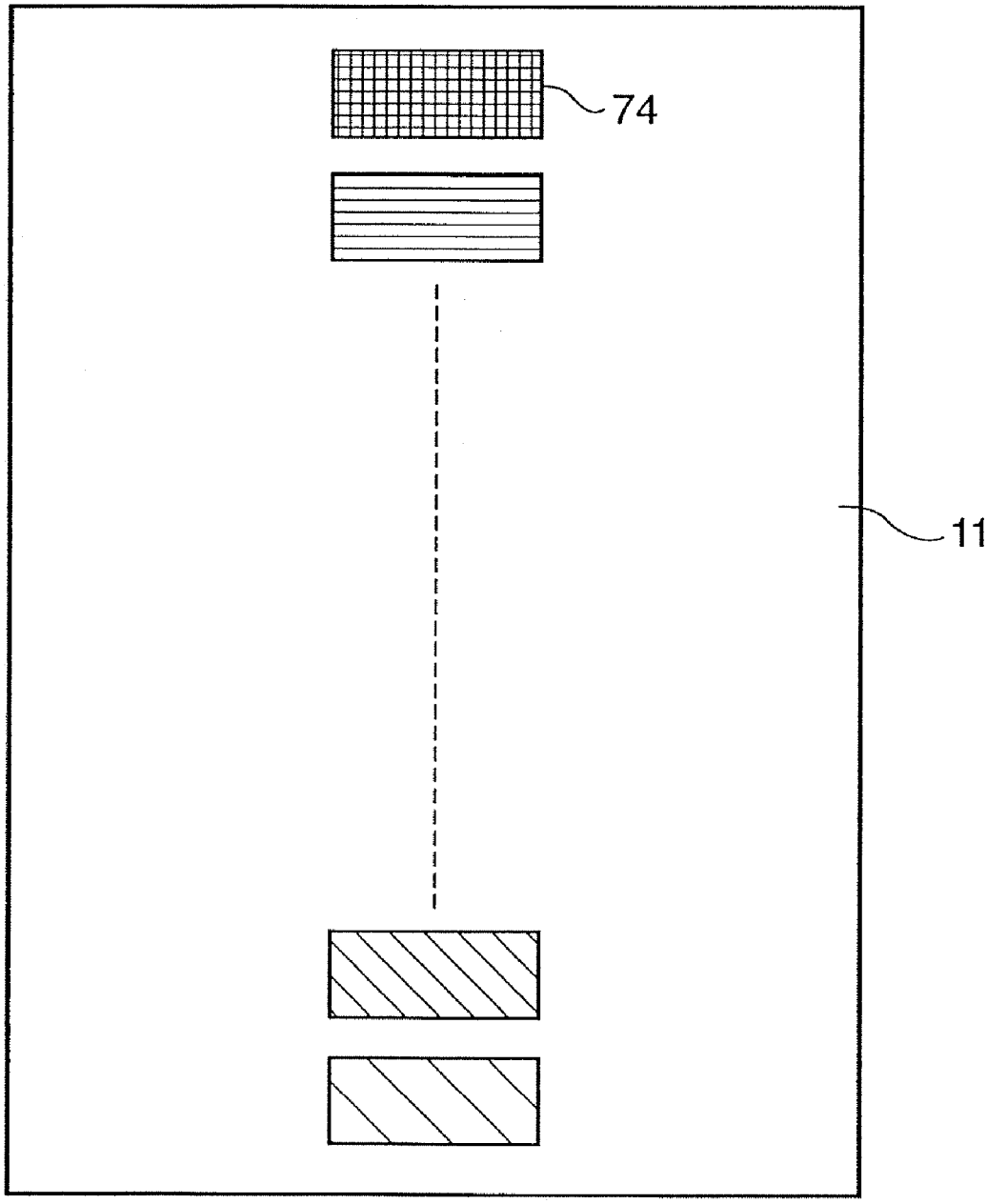
PRIOR ART FIG. 13
FIG. 13 is a view showing an example of a patch pattern in a prior art.

When controlling the density or chromaticity using the above-described color sensors 42, only one color sensor is mounted for each conventional color image forming apparatus. Hence, the patterns must be formed as shown in FIG. 13. The pattern shown in FIG. 13 is realized when arranging the color sensors 42 at the center in the scan direction. Since patches 74 can be formed only at the center of the transfer material 11 in which the color sensors 42 can detect them, both the sides of the transfer material 11 become wasted spaces.

Figure 14:
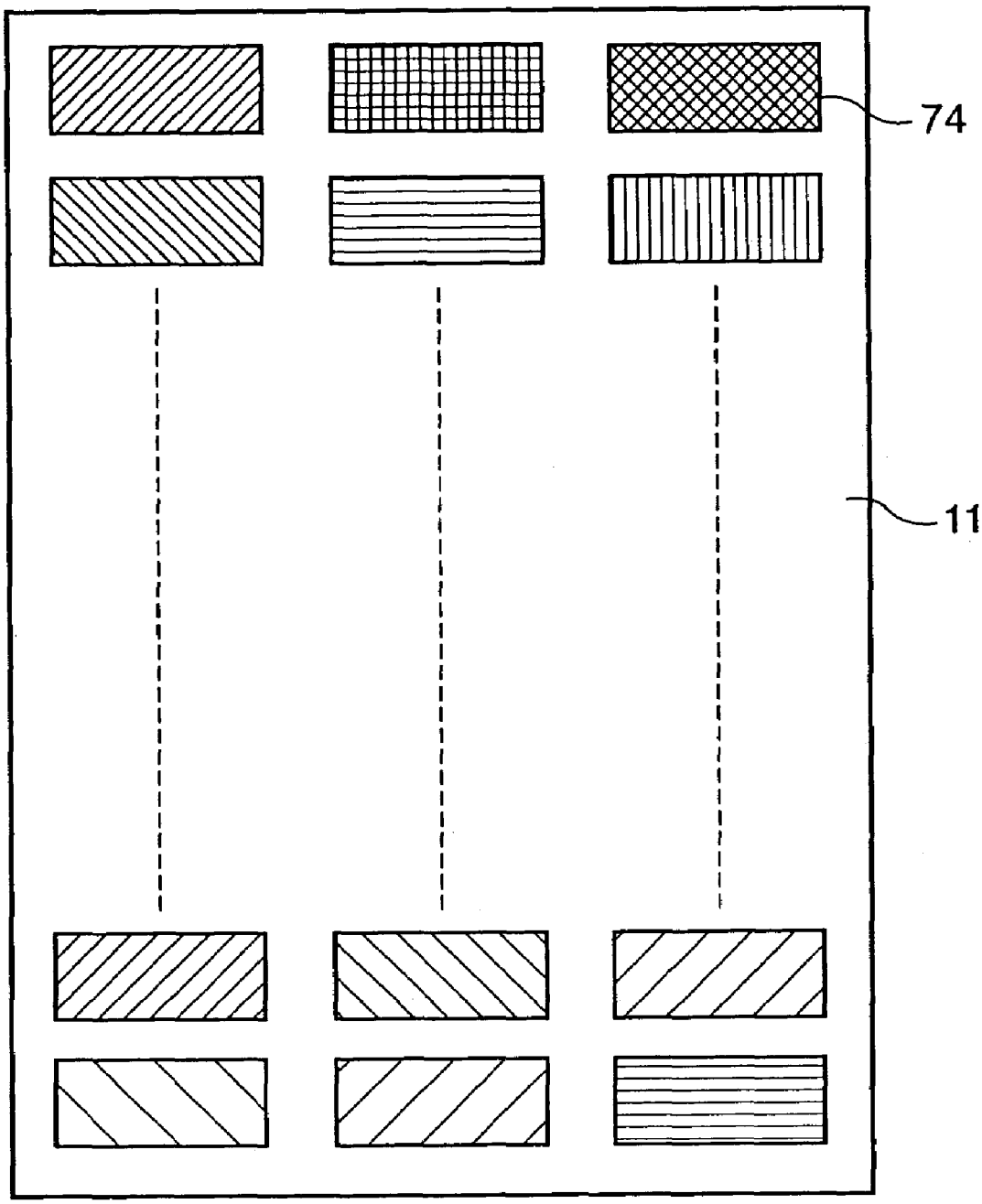
FIG. 14 is a view showing an example of a patch pattern according to the second embodiment.

When three color sensors 42(1) to 42(3) are mounted in the scan direction as in the second embodiment, the pattern can be formed as shown in FIG. 14. Since the patches 74 can be detected at the three positions in the scan direction, three lines of patterns can be formed on the transfer material 11. That is, the number of patches 74 is three times that of the conventional patches in FIG. 13. Of course, all of the patches have different image signals. The larger the number of color sensors 42 arranged in the scan direction, the larger the number of patches available.

Note that, in the electrophotographic color image forming apparatus, the patches 74 of the second embodiment must be formed after reducing the density or chromaticity variations in the scan direction by the method in the first embodiment. With this operation, a plurality of color sensors 42 can be used without being influenced by the specific density or chromaticity variations specific to the electrophotographic color image forming apparatus in the scan direction.

In the prior art, the following color image forming apparatus has been proposed, which comprises the color sensor 42 such that the mixture rate of cyan (C), magenta (M), and yellow (Y) for forming an achromatic gray scale image of a process gray patch can be output by forming a gray patch of black (K) and the process gray patch of C, M, and Y on the transfer material, and comparing the gray patch of K with the process gray patch of C, M, and Y as a reference after fixing the toner. In this color image forming apparatus, it is apparent that the color reproducibility from light to deep colors can be improved when the mixing ratio of the C, M, and Y colors, with which the process gray patch becomes achromatic can be output in a plurality of tonalities from light to deep colors. Alternatively, it is also apparent that, when the number of tonalities is small, the color reproducibility is relatively degraded. That is, the larger the number of patches used, the more the color reproducibility is improved in the color image forming apparatus.

As described above, in the second embodiment, the number of patches formed on the single transfer material 11 can be increased, wasteful consumption of the transfer material 11 is prevented, and the color reproducibility of the color image forming apparatus can be improved.

Third Embodiment

In the third embodiment, a color sensor 62 integrally having a plurality of color sensors 42 arranged in the scan direction according to the first and second embodiments will be described.

Figure 15A:
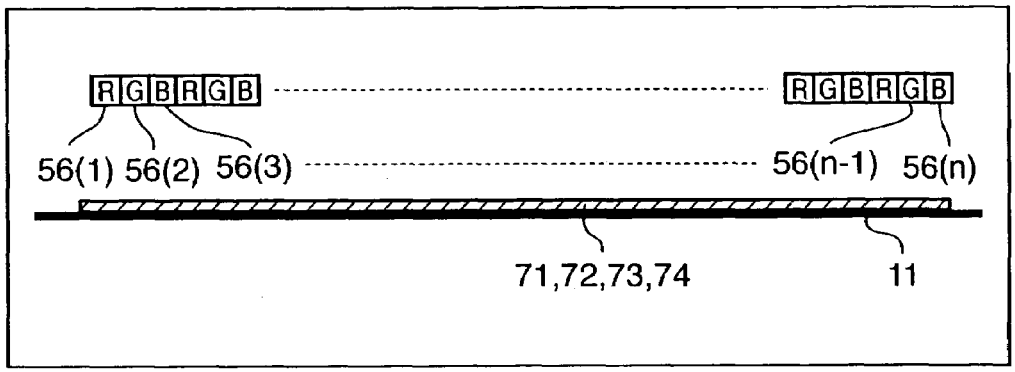
FIGS. 15A and 15B are views showing the arrangement of a color sensor according to the third embodiment.
Figure 15B:
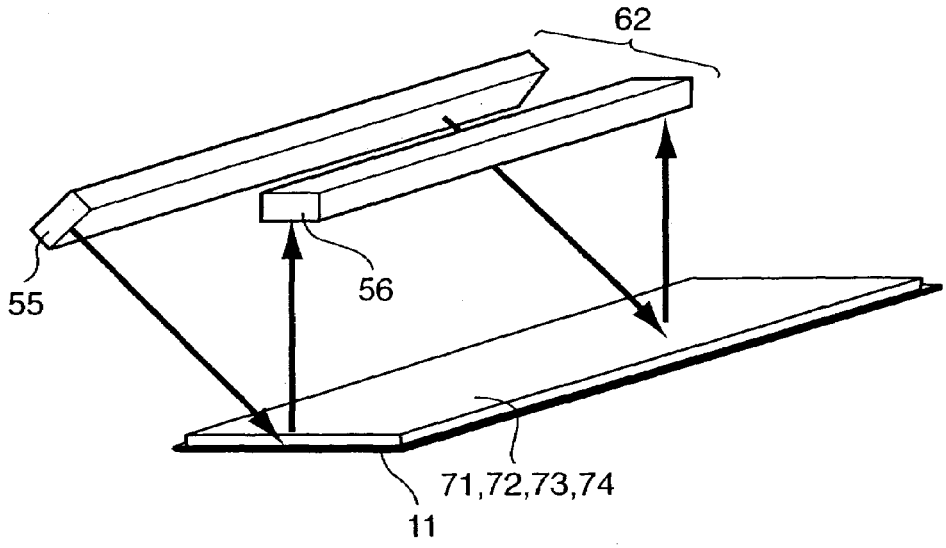

FIGS. 15A and 15B show the color sensor 62 in the third embodiment. The color sensor 42 comprises a white LED 55 and a charge storage sensor 56 with on-chip filter of three, R, G, and B colors. As shown in FIG. 15A, in the charge storage sensor 56 with an on-chip filter, sensors 56(1) to 56(*n*) corresponding to different colors are sequentially arranged over the whole image forming region on the transfer material 11 in accordance with a predetermined rule. Referring to FIG. 4 in the first embodiment, the third embodiment may be implemented by sequentially arranging charge storage sensors 54*b* with on-chip filters in the horizontal direction. In FIGS. 15A and 15B, R, G, and B colors are repeatedly arranged. However, the present invention is not limited to this. Also, as shown in FIG. 15B, the white light source 55 can irradiate the transfer material 11 over the whole image forming region in the scan direction. This light source can be implemented by arranging n white LEDs in correspondence with the sensors 56(1) to 56(*n*). In addition to this, the light source can be implemented by, e.g., a fluorescent tube, and an LED and light guide member. In this arrangement of the light-emitting device 55 and the light-receiving device 56 as described above, the density or chromaticity can be detected over the whole image forming region in the scan direction on the transfer material 11.

The color sensor 62 in this embodiment can be implemented at lower cost than that in the first embodiment where a plurality of color sensors 42 are arranged over the whole image forming region in the scan direction, since the plurality of color sensors are integrally formed in this embodiment.

When the color sensors 62 are mounted in the image forming apparatus in this embodiment to perform the control processes of the primary transfer bias, secondary transfer bias, transfer bias, and fixing temperature of the first embodiment, these control processes can be performed with higher precision, since the number of positions in which the densities or chromaticity values can be detected in the scan direction increases.

Also, since the color sensors 62 of the third embodiment are mounted in the image forming apparatus, as described in the second embodiment, a plurality of patches corresponding to different image data can be arranged over the whole image forming region of the transfer material 11 in the scan direction.

As described above, in the third embodiment, the color sensors 62 of this embodiment are mounted to perform the control and form the patches according to the first and second embodiments. Hence, the image quality and color reproducibility of the color image forming apparatus can be further improved at lower cost. In the above description, the present invention has been described with respect to the preferred embodiments. However, the present invention is not limited to these embodiments. It is apparent that various modifications and applications may be effected within the appended claims.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-139088 filed on May 7, 2004, which is hereby incorporated by reference herein.

What is claimed is:

1. An image forming apparatus having a discharge section which discharges a recording medium on which an image is formed, comprising:

a plurality of detecting sections which detect densities or chromaticity values of test images formed on the recording medium; and an image forming section which controls to form an image by using detection results obtained by the detecting sections, wherein the plurality of detecting sections are arranged in a first direction perpendicular to a conveyance direction of the recording medium, and wherein a plurality of test images are formed in an image forming region in the first direction, and a plurality of rows of test images are formed in the conveyance direction, and the test images formed on the recording medium before discharge of the recording medium to the discharge section are detection objects for detection of the densities or chromaticity values by the detecting sections.

2. The apparatus according to claim 1, wherein the plurality of rows of test images are formed in the conveyance direction to run over a whole image forming region in the first direction.

3. The apparatus according to claim 1, wherein each of the detecting sections includes a plurality of light-receiving devices which run over the whole image forming region in the first direction on the recording medium, and a light-emitting device irradiating the image forming region in the first direction.

4. The apparatus according to claim 1, further comprising a determination section which determines the test image with which the density difference or color difference is largest as a test image with which density variations or chromaticity variations is large in the plurality of test images formed in the first direction.

5. An image forming apparatus having a discharge section which discharges a recording medium on which an image is formed, comprising:

a plurality of detecting sections which detect densities or chromaticity values of test images formed on the recording medium, wherein the plurality of detecting sections are arranged in a first direction perpendicular to a conveyance direction of the recording medium;

an image forming section which controls to form an image by using detection results obtained by the detecting sections;

a photosensitive member;

a transfer material onto which the image exposed by the photosensitive member is transferred;

an adjusting section which adjusts a primary transfer bias when transferring the image from the photosensitive member to the transfer material; and a setting section which forms the plurality of test images with a single image signal on the transfer material upon the adjusting section changing the primary transfer bias, detects the densities or chromaticity values of the test images of the primary transfer bias, and sets the primary transfer bias of the test image with which density or chromaticity variations are smallest in the detection result as the primary transfer bias in forming the image, wherein the test images formed on the recording medium before delivery are an object of detection by the detecting sections, and the test images formed on the recording medium before discharge of the recording medium to the discharge section are detection objects for detection of the densities or chromaticity values by the detecting sections.

6. An image forming apparatus having a discharge section which discharges a recording medium on which an image is formed, comprising:

a plurality of detecting sections which detect densities or chromaticity values of test images formed on the recording medium, wherein the plurality of detecting sections are arranged in a first direction perpendicular to a conveyance direction of the recording medium;

an image forming section which controls to form an image by using detection results obtained by the detecting sections;

a photosensitive member;

a transfer material onto which the image exposed by the photosensitive member is transferred;

an adjusting section which adjusts a secondary transfer bias when transferring the image from the photosensitive member to the transfer material; and a setting section which forms the plurality of test images with a single image signal on the transfer material upon the adjusting section changing the primary transfer bias, detects the densities or chromaticity values of the test images of the primary transfer bias, and sets the secondary transfer bias of the test image with which density or chromaticity variations are smallest in the detection result as the primary transfer bias in forming the image, wherein the test images formed on the recording medium before delivery are an object of detection by the detecting sections, and the test images formed on the recording medium before discharge of the recording medium to the discharge section are detection objects for detection of the densities or chromaticity values by the detecting sections.

7. An image forming apparatus having a discharge section which discharges a recording medium on which an image is formed, comprising:

a plurality of detecting sections which detect densities or chromaticity values of test images formed on the recording medium, wherein the plurality of detecting sections are arranged in a first direction perpendicular to a conveyance direction of the recording medium;

an image forming section which controls to form an image by using detection results obtained by the detecting sections;

an adjusting section which adjusts a transfer bias when transferring the image exposed by a photosensitive member to a transfer material and a setting section which forms the plurality of test images with a single image signal on the recording medium upon the adjusting section changing the transfer bias, detects the densities or chromaticity values of the test images of the transfer bias, and sets the transfer bias of the image with which density or chromaticity variations are smallest in the detection result as the transfer bias in forming the image, wherein the test images formed on the recording medium before delivery are an object of detection by the detecting sections, and the test images formed on the recording medium before discharge of the recording medium to the discharge section are detection objects for detection of the densities or chromaticity values by the detecting sections.

8. An image forming apparatus having a discharge section which discharges a recording medium on which an image is formed, comprising:

a plurality of detecting sections which detect densities or chromaticity values of test images formed on the recording medium, wherein the plurality of detecting sections are arranged in a first direction perpendicular to a conveyance direction of the recording medium;

an image forming section which controls to form an image by using detection results obtained by the detecting sections;

a fixing section which heats and fixes the image transferred onto the recording medium;

an adjusting section which adjusts a fixing temperature when fixing the image; and a setting section which forms the plurality of test images with a single image signal on the recording medium upon the adjusting section changing the fixing temperature, detects the densities or chromaticity values of the test images in the fixing temperature, and sets the fixing temperature of the image with which density or chromaticity variations are smallest in the detection result as the fixing temperature in forming the image, wherein the test images formed on the recording medium before delivery are an object of detection by the detecting sections, and the test images formed on the recording medium before discharge of the recording medium to the discharge section are detection objects for detection of the densities or chromaticity values by the detecting sections.

9. An image forming apparatus having a discharge section which discharges a recording medium on which an image is formed, comprising:

a plurality of detecting sections which detect densities or chromaticity values of test images formed on the recording medium, wherein the plurality of detecting sections are arranged in a first direction perpendicular to a conveyance direction of the recording medium;

an image forming section which controls to form an image by using detection results obtained by the detecting sections;

a determination section which determines the density variations or the chromaticity variations in the test image by a variance or a standard deviation of the densities or chromaticity values of the plurality of test images formed in the first direction, wherein the test images formed on the recording medium before delivery are an object of detection by the detecting sections, and the test images formed on the recording medium before discharge of the recording medium to the discharge section are detection objects for detection of the densities or chromaticity values by the detecting sections.

10. An image forming apparatus comprising:

a plurality of detecting sections which detect densities or chromaticity values of test images formed on a recording medium, wherein the plurality of detecting sections are arranged in a first direction perpendicular to a conveyance direction of the recording medium and detect the density or chromaticity of each of the plurality of different test images formed in the first direction;

an image forming section which controls to form an image by using detection results obtained by the detecting sections;

a developing section which develops an image exposed by a photosensitive member; and a stirring section which stirs toner in the developing section, wherein the stirring section stirs the toner in the developing section when the density variations or chromaticity variations in the test image exceed a predetermined value.

* * * * *

UNITED STATES PATENT AND TRADEMARK OFFICE

CERTIFICATE OF CORRECTION

PATENT NO. : 7,269,369 B2
APPLICATION NO. : 11/114076
DATED : September 11, 2007
INVENTOR(S) : Hiroki Tezuka et al.

It is certified that error appears in the above-identified patent and that said Letters Patent is hereby corrected as shown below:

COLUMN 3:

Line 41, "are" should read --is--.

COLUMN 12:

Line 18, "is" should read --are--.

Signed and Sealed this

Eighth Day of July, 2008

JON W. DUDAS
*Director of the United States Patent and Trademark Office*